US008232507B2

(12) United States Patent
Baier et al.

(10) Patent No.: US 8,232,507 B2
(45) Date of Patent: Jul. 31, 2012

(54) OPERATING DEVICE FOR AN ELECTRIC APPLIANCE SUCH AS A HOB AND ARRANGEMENT THEREOF

(75) Inventors: Martin Baier, Ettlingen (DE); Lutz Ose, Sternenfels (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 12/688,331

(22) Filed: Jan. 15, 2010

(65) Prior Publication Data

US 2010/0140249 A1 Jun. 10, 2010

Related U.S. Application Data

(63) Continuation of application No. PCT/EP2008/005720, filed on Jul. 14, 2008.

(30) Foreign Application Priority Data

Jul. 18, 2007 (DE) ..... 10 2007 034 703

(51) Int. Cl.
*A21B 1/00* (2006.01)

(52) U.S. Cl. ..... 219/412; 219/407; 219/400; 219/489; 219/385; 219/392; 219/521

(58) Field of Classification Search ..... 219/412, 219/407, 400, 489, 385, 392, 521
See application file for complete search history.

(56) References Cited

U.S. PATENT DOCUMENTS

| | | | |
|---|---|---|---|
| 5,920,131 | A | 7/1999 | Platt et al. |
| 2001/0008237 | A1 | 7/2001 | Essig |
| 2006/0049172 | A1 | 3/2006 | Gagas et al. |

FOREIGN PATENT DOCUMENTS

| | | | |
|---|---|---|---|
| AT | 500 128 | | 10/2005 |
| DE | 198 10 438 | A1 | 3/1999 |
| DE | 100 26 058 | | 11/2001 |
| DE | 100 26 058 | A1 | 11/2001 |
| DE | 100 52 585 | * | 5/2002 |
| DE | 100 52 585 | A1 | 5/2002 |

(Continued)

OTHER PUBLICATIONS

German Office Action from German Application No. 10 2007 034 703.2.

International Search Report from PCT/EP2008/005720 dated Feb. 4, 2009.

(Continued)

*Primary Examiner* — Shawntina Fuqua
(74) *Attorney, Agent, or Firm* — Alston & Bird LLP

(57) ABSTRACT

An operating device for an electric hob comprises a plurality of touch pads as touch points, in which operation takes place by applying a finger to specific defined touch points. The touch pads may be in themselves structurally movable separately of the electric hob or the operating device. The touch pads comprise individual coding circuits which can be accomplished by way of modulation of an electromagnetic field. The operating device has an electrode surface for attachment next to the electric appliance, on which the touch pads are arranged. Capacitive coupling is formed between the touch pads and the electrode surface. The operating device comprises a drive and evaluation device connected to the electrode surface both for detecting touching of a touch pad in general and for detecting and differentiating between touching of a specific touch pad and touching of another touch pad as indicated by the individual coding circuit.

24 Claims, 2 Drawing Sheets

FOREIGN PATENT DOCUMENTS

| | | |
|---|---|---|
| DE | 500 128 B1 | 3/2007 |
| EP | 0 797 227 | 9/1997 |
| EP | 1 107 647 | 6/2001 |
| EP | 1 947 552 A1 | 7/2008 |

OTHER PUBLICATIONS

English Translation of the International Preliminary Report for PCT/EP2008/005720 dated Feb. 9, 2010.

* cited by examiner

OPERATING DEVICE FOR AN ELECTRIC APPLIANCE SUCH AS A HOB AND ARRANGEMENT THEREOF

CROSS REFERENCE TO RELATED APPLICATIONS

This application is a continuation of PCT/EP2008/005720, filed Jul. 14, 2008, which in turn claims priority to DE 10 2007 034 703.2, filed on Jul. 18, 2007, the contents of which are incorporated by reference.

FIELD OF THE INVENTION

The invention relates to an operating device for an electric appliance such as for example a hob, an oven or an extractor (vent) hood, the operating device being operated by the application of a finger to specific defined touch points. The invention likewise relates to an electric appliance with such an operating device or an arrangement of an electric hob with such an operating device.

BACKGROUND OF THE INVENTION

It is known to provide electric hobs, for example, with "touch switches" having touch sensors. These trigger an operating function when a finger is placed on a specific labeled point on the hob plate. The operating principle is based on, for example, detecting capacitance, such that capacitive coupling may be detected between the finger placed on the hob plate and a corresponding touch sensor under the hob plate, which is connected to a drive and evaluation circuit.

Furthermore, German Patent DE 10361341A discloses an operating device which does not even require touching with the finger, but may instead even detect when a finger approaches a specific touch point. However, the problem here frequently arises that an operator does not recognize precisely at which point or in what way the finger has to be positioned for the desired operation.

FIELD OF APPLICATION AND PRIOR ART

One object of the present invention is to provide an above-mentioned operating device, a corresponding electric appliance and the arrangement of such an operating device with an electric hob, with which the problems of the prior art may be avoided and, in particular, an individually configurable and versatile operating device or operation of an electric appliance may be achieved.

This object is achieved in one embodiment by an operating device having the features as claimed herein. Advantageous and preferred configurations of the invention are explained in greater detail below. The wording of the claims is incorporated by express reference into the content of the description. Moreover, the wording of priority application DE 102007034703.2 filed on Jul. 18, 2007 is incorporated by express reference into the contents of the present description.

One embodiment of invention provides an operating device with a plurality of touch pads in the form of separate parts having touch points. They are configured structurally such that the touch pads may be moved separately of the electric appliance or of the operating device and may take the form of separate, unfixed parts. They form a type of sensor or sub-sensor for the operating device for identifying contact resulting from application of a finger or the like. Moreover, they are individually coded (e.g., identified to the controller). This is explained in greater detail below. The operating device comprises an electrode surface or coil as a general receiving means, which is arranged on, or next to, the electric appliance. At least one of the touch pads is arranged for operation on the electrode surface or the coil or alternatively close thereto, for example, offset somewhat to the side. Between the touch pads and the electrode surface or the coil, a capacitive or inductive coupling then forms, such that, if a touch pad forms as it were a first subsensor, the electrode surface or coil forms the other subsensor. Capacitive coupling may advantageously be configured as in the case of conventional capacitive contact switches, for example corresponding to that disclosed in U.S. Pat. No. 5,973,417. The electrode surface or coil is connected to a drive and evaluation device (such as a microcontroller) of the operating device. In this way, touching of a touch pad may be detected per se, and it is in particular also possible to detect and differentiate which touch pad has been touched. For instance, touching of any one touch pad may be differentiated from touching of one of the other touch pads. In this way, an operating function may be triggered which is assigned to that particular touch pad. The operating function can be indicated, for example by labeling or the like of this touch pad. In the case of inductive coupling, the touch pad may be inductively supplied with power. A capacitive sensor system on the operating pad allows detection of application of a finger and this information is transmitted to the drive and evaluation circuit together with the above-mentioned coding, such as by means of modulation of the electromagnetic field.

It is thus possible, with certain embodiments of the invention, to arrange specific touch pads with specific assigned functions, with which the touch pads are labeled, for example by corresponding printed symbols or the like, in many different or any desired ways. In this case, they have however to be arranged on the frame or in regions of the electrode surface or the coil. If, however, this electrode surface or coil is large and arranged either under a hob plate of a hob forming an electric appliance or next thereto, it is advantageously of such a size that the touch pads may be placed thereon. In principle, the electrode surface or coil may detect touching of each one of the touch pads as touching of a touch pad per se. Through individual coding of the touch pad, the drive and evaluation device may detect precisely the touch pad being touched and then trigger an operating function assigned to that touch pad. Thus, an operator may, as it were, set up or configure an individual operating device with little effort, such as in the case of an electric hob arrangement of operating elements, for raising or lowering power in any desired way. Likewise further operating functions such as a timer, on/off switch or hot plate selection switch can be accomplished. These touch points or touch pads may be individually reset without their functioning being impaired. Further possibilities are revealed by the following description.

As disclosed, an electrode surface or coil may be arranged in one embodiment under a hob plate of a hob. In this respect, it may either occupy a sub-area or the majority of the area of the electric hob. In particular, it is also possible to subdivide the electrode surface into a plurality of different electrodes, for example corresponding to the hot plates of the hob plate. In the case of touch pads which are attached to a metallic cooking utensil, for example by clipping onto a handle, it is then possible, by transmission via the metallic cooking utensil itself, for an electrode or coil to use its drive and evaluation circuit to detect both contact with this touch pad and the individual coding thereof and to evaluate them as a corresponding operating function. If the operating function is for an increase in power, for example, the drive and evaluation circuit may immediately detect this increase in power for the heating unit assigned to the hot plate by the cooking utensil and the corresponding electrode and increase said power. No separate input is then necessary for selection of the hot plate, as has been necessary in the prior art. As a further alternative, an electrode surface or coil may be provided along a front edge or a front zone, such that different touch pads for operating the hob may be positioned along this strip.

As an alternative to a hob, an extractor or venting hood may be provided with such an electrode surface or coil, advantageously behind a front face of the extractor hood or behind an also wide front side edge. This face should be large enough for a plurality of touch pads to be arranged thereon or attached thereto. These then form the operating device for the extractor hood, under certain circumstances also additionally for a hob coupled thereto. The electric appliance may likewise be an oven.

In another embodiment of the invention, the electric appliance may be arranged on, in, or under a work surface. The electrode surface or coil is in this case provided on, or under, the work surface, advantageously at a relatively small distance from the electric appliance, in particular just next thereto. The touch pads may then in turn be arranged individually on this electrode surface, coil, or on the work surface. Thus, for example, in the case of an electric hob, no valuable or needed space on the hob plate is needed for arrangement of the touch pads or the operating device. This also avoids temperature problems at or on a hob plate. The size of an electrode surface or coil under a hob plate of a hob, or also next thereto under a work surface may, in the case of a rectangular configuration, range from a side length of a few centimeters, for example, up to 60 cm.×60 cm. or even larger.

It is possible to configure the electrode surface or the coil as a metallic coating on the bottom of a hob plate. This is known from the prior art by a person skilled in the art, such that a metallic layer or coating on the bottom of a vitreous ceramic plate or the like constituting the hob plate does not represent any problem. Alternatively, an electrode surface may take the form of a thin metallic layer, specifically either of a metal plate or of an adhesive metal foil, which may be bonded to the bottom of a work surface using adhesive.

In a further configuration of the invention, it is not only possible for the touch pads to be configured as individual parts in the manner of flat disks or the like, but rather for a plurality of touch pads to form a structural unit together with a support. They may be connected together jointly and interconnectedly, and at the same time with different functions, in particular, comprising all the touch pads or functions necessary for complete operation of the electric appliance. Such a joint structural unit may advantageously be flat. The touch pads may be highlighted or identified optically, by corresponding symbols, or colors or the like. Alternatively, they may be raised somewhat or comprise indentations relative to the support.

Moreover, the touch pads may be configured with the support in the manner of a disk or plate. The support may either be rigid, i.e., like a flat board, or it may alternatively be resilient or flexible, in the manner of a mouse pad or the like. Advantageously, the touch pads are produced individually, then provided with individual coding for identification to the control circuit, and are then built into the carrier or incorporated therein or attached thereto. Such a support produces a type of remote control, with the difference that in a preferred configuration no separate power supply is provided, a plurality of functions are included, and this remote control has to be arranged within a specific constricted zone or within a specific area, so that capacitive coupling may proceed between the touch pads and the electrode surface or electromagnetic coupling between touch surface and coil. At the same time, the support may be arranged, with the touch pads, individually or differently within one such electrode surface or coil, especially if this is of relatively large and extensive construction. In this way, a degree of individualization may take place.

Individual coding of the touch pads may proceed by means of the internal wiring thereof. One option for individually coding each touch pad uses inductive or electromagnetic coupling using a type of transponder principle, i.e., coding as with a transponder.

Touching of a touch pad may be detected in general as touching via capacitive coupling and transmission to the electrode surface or by electromagnetic coupling to the coil. At the same time, a corresponding signal with the individual coding is provided, such that specific touching may also be detected by the evaluation circuit and an operating function associated therewith may be triggered.

Under certain circumstances it is meaningful and advantageous to provide an energy storage means in a touch pad. This may be a battery. In this way, individual coding may also be produced, for example by providing touching of a specific touch pad not only with the individual coding, but rather additionally by impressing a signal thereon.

If the touch pads are separately configured, they can be flat and disk-like in a preferred embodiment. Their diameter may be in the range, for example, of a few centimeters and their height may even be less than a centimeter. They may have specific graphic symbols or the like on the top thereof, to clarify their operating function. Furthermore, it is advantageous to make the touch pads electrically conductive in an outer zone, in particular over a relatively large surface area, for example, in the form of a metal coating or metal surface. For instance, touching the capacitive coupling to the electrode surface or the electromagnetic coupling to the coil with a finger is particularly readily detectable. A touch pad is particularly preferably touched on the top.

In another embodiment of the invention, it is recommended to provide the touch pads with attaching means. In this way, they may be positioned in a fixed relationship to the electrode surface or coil or at a specific point thereon. At the same time, they may be detached and removed to change the configuration, in particular also to provide child-proofing. Finally, operation or touching of the touch pads is simpler and more convenient if they do not move of their own accord.

One possible option for attaching means is retention by means of magnetic force. To this end, the touch pads may comprise a retaining magnet or magnetic material. A touch pad may then be attached to a surface provided therefore, in particular by way of an electrode surface or coil arranged next to a hob, or to a metal pan. Alternatively, attachment may be achieved by means of a clamping action, for example in the form of clamps or clips or the like. Thus, a touch pad may be attached to a pan, for example, to a handle, a side edge or a lid. Electrical contacting to a metallic pan should here occur for signal transmission upon attachment. Finally, it is possible to provide the bottom of a touch pad with a suction cup or a rubber-like surface with a strong grip. In this way, when a touch pad is positioned on a smooth surface such as for example the top of a hob plate of an electric hob, slight displacement or a degree of attaching action may be brought about, which is sufficient for normal operation.

These and further features follow not only from the claims but also from the description and the drawings, the individual features being realized in each case alone or several together in the form of sub-combinations in various embodiments of the invention and in other fields and may constitute advantageous, per se protectable embodiments, for which protection is here claimed. Subdivision of the application into individual sections and intermediate headings does not limit the general applicability of the statements made thereunder.

BRIEF DESCRIPTION OF THE DRAWINGS

Exemplary embodiments of the invention are illustrated schematically in the drawings and explained in more detail below, where in the drawings.

DETAILED DESCRIPTION OF THE EXEMPLARY EMBODIMENTS

Figure 1:
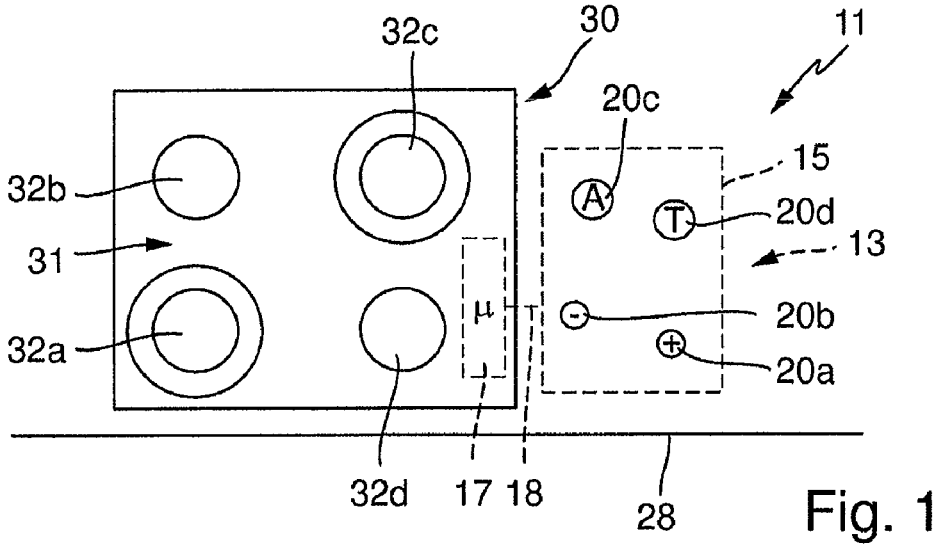
FIG. 1 shows a plan view of a first configuration of a hob according to one embodiment of the invention with an operating device according to the invention to the side thereof.

FIG. 1 shows a first configuration of an arrangement 11 according to one embodiment of the invention of an operating device 13 with a hob 30 on a work surface 28. The operating device 13 is located under the work surface 28, as is indicated by the broken lines. The hob 30 is inserted, as is conventional, into a corresponding opening.

The operating device 13 on the one hand has an electrode surface 15 shown by broken lines. This may take the form, for example, of an electrically conductive or metallic adhesive film and may be adhesively bonded to the bottom of the work surface 28. It is connected to a controller 17 of the hob 30 by means of an illustrated electrical connection 18, for example, a cable. This controller 17 also assumes the role of the above-described drive and evaluation device for the operating device 13. Alternatively, it is also possible for the operating device 13 to have its own controller for drive and evaluation. The electrode surface 15 may also be configured differently from the illustration. This may, however, be achieved without difficulty by a person skilled in the art and moreover further embodiments are described below.

Figure 3:
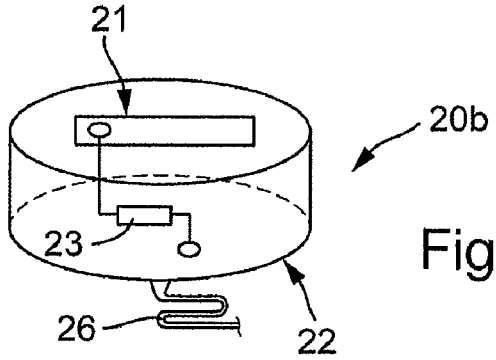
FIG. 3 is an oblique view of a touch pad of an operating device according to one embodiment of the invention with a circuit for touch detection, coding and modulation and clips on the bottom.

The operating device 13 also comprises a plurality of touch pads 20*a* to 20*d*. As the oblique view in FIG. 3 shows, these are configured in the manner of flat disks, for example with a diameter of 1 to 4 cm and a thickness of 0.2 cm to 2 cm. The touch pads 20 are positioned on the work surface 28 in the region of the electrode surface 15. For more precise identification, marking corresponding to the electrode surface 15 could be provided on the top of the work surface 28.

The touch pads 20*a*-20*d* are identified with symbols or letters. The touch pad 20*a* has a plus sign ("+"), for example, and the touch pad 20*b* has a minus sign ("−"), for example. This means that the power, or another value of the hob 30, may be changed thereby or adjusted upwards or downwards. The touch pad 20*c* comprises a capital letter "A" as symbol and represents an initial heat-up phase. The touch pad 20*d* comprises a capital letter "T" for setting a timer function. It goes without saying that further touch pads 20 may be provided. The touch pads 20 may also have different sizes or shapes. It is however advantageous for them to be of identical size.

It is clear from the oblique illustration in FIG. 3 that a minus sign symbol is present on the top 21 of the touch pad 20*b*. The top 21 is advantageously electrically conductive or even metallic. The outer surface of the touch pad 20*b* may otherwise likewise also be metallic. The circuit 23 is connected to the bottom of the conductive top 21 for touch detection, coding and modulation. It takes the form of a "black box," as its specific configuration for this purpose is not defined and can be readily determined by a person skilled in the art. This circuit 23 is in turn connected to an electrically conductive bottom 22 of the touch pad 20*b*, which is not in electrically conductive connection with the top 21 and for example is in turn metallic. Finally, a clip 26 is provided on the bottom 22 as attaching means, to hold a touch pad 20 in a specific location. Instead of the clip 26, a suction cup (not shown) may be provided. Such attaching means may likewise take the form of flat rubber pads with the greatest possible friction, so that the touch pads may be positioned in a reasonably locationally secure manner, for example, on the work surface 28 according to FIG. 1.

Functioning of FIG. 1

With regard to functioning, it should be stated that the touch pads 20*a*-20*d*, which are configured according to FIG. 3, are placed on the work surface 28 above the electrode surface 15. When one of the touch pads 20 or the top 21 thereof is touched with a finger, information is transmitted from the touch pad 20 to the electrode surface 15 by means of the circuit 23 for touch detection, coding and modulation, and said electrode surface 15 is in turn connected to the controller 17. Thus, as in the case of conventional capacitive touch-sensitive switches, as are known for example from U.S. Pat. No. 5,973,417 or U.S. Patent Publication 2007-0051610, touch may be evaluated for operating the hob. By means of the touch pads 20, which are freely displaceable and positionable compared to the electrode surface 15, a particular operating function, represented by the symbol on the touch pad 20, may be arranged at any desired location for individually configurable optimal operation.

A further advantage of the touch pads 20*a*-20*d* being individually displaceable and locatable within the electrode surface 15 is that displacement may theoretically be effected even during operation. In the configuration according to FIG. 1, the electrode surface 15 cannot register precisely where a touch pad 20 is arranged which has been touched, such that said pad may also be displaced. A further advantage is a type of child-proofing, since the touch pads 20 can be removed and placed away after operation of the hob 30 and thus the hob can also no longer be switched on or operated.

DESCRIPTION OF THE FURTHER EXEMPLARY EMBODIMENTS

Figure 2:
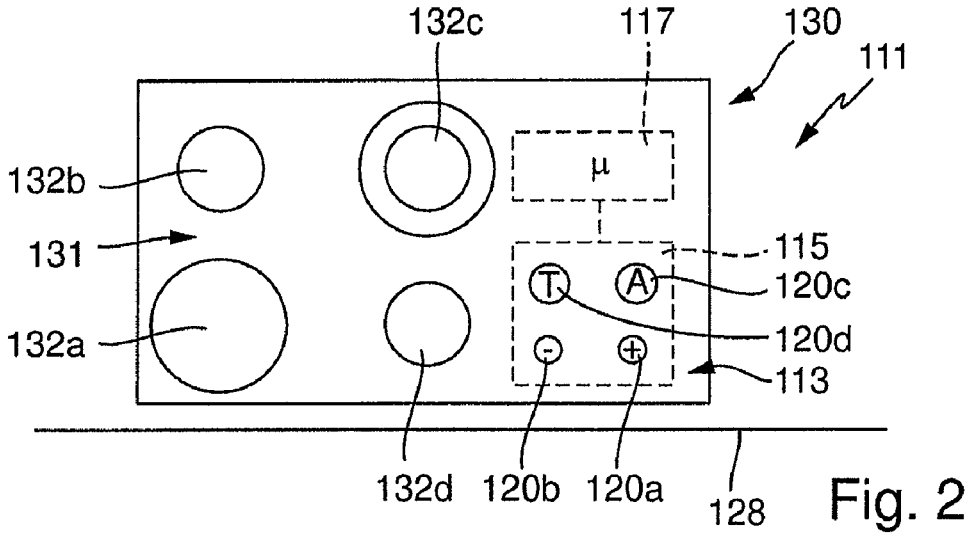
FIG. 2 shows a modification of the hob of FIG. 1 with the operating device on the hob.

FIG. 2 shows an arrangement 111 of an operating device 113 according to the invention in a hob 130. The hob 130 has been inserted into an opening in the work surface 128. An electrode surface 115 is arranged on the right under a hob plate 131, for example in turn adhesively bonded as a metal foil to the bottom of the hob plate 131. The electrode surface 115 is connected to a controller 117 of the hob 130 for actuation and evaluation.

Touch pads 120*a* to 120*d* are positioned on the hob 130 or the hob plate 131 in accordance with FIG. 1. They may be displaced within the electrode surface 115 and at the same time fulfill their function as touch points, as has previously been described. Just as the capacitive coupling between electrode surface 15 and touch pad 20 takes place in FIG. 1 through the work surface 28, in FIG. 2 it takes place through the hob plate 131.

Selection of one of the hot plates 132*a* to 132*d* may proceed either by operating elements which are not illustrated, or alternatively provision may be made, for convenient operation, for a pan's touching a hot plate 132 to be detected. This can occur, for example, according to EP 1580487A or according to EP 1768258A, and can be regarded as selection of this hot plate for a subsequent power change, for example.

Figure 4:
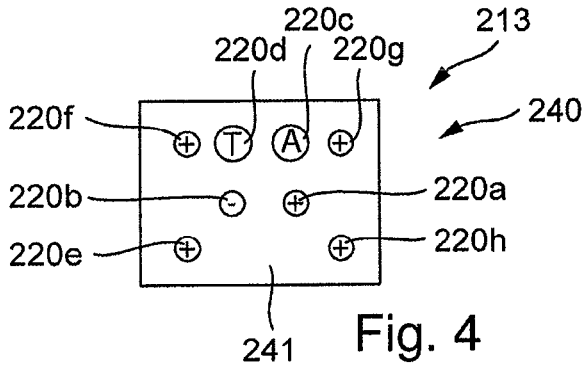
FIG. 4 shows a further configuration of an operating device according to the invention with a plate containing a plurality of touch pads.

Yet another configuration of an operating device according to the invention is illustrated in FIG. 4, with a flexible plate 240 which may consist, for example, of rigid plastic or a resilient rubber material or the like. The plate 240 comprises a plate body 241. A number of touch pads 220*a* to 220*h* are arranged therein. The touch pads 220*a* to 220*d* are configured here to correspond with those of FIG. 1 with identical functions. The touch pads 220*e* to 220*h* show by their symbols that they are selection buttons for one of the four hot plates on a hob according to FIG. 1 or FIG. 2. By touching them, the hot plate associated with the corresponding symbol may be activated or selected for power setting or the like.

Figure 5:
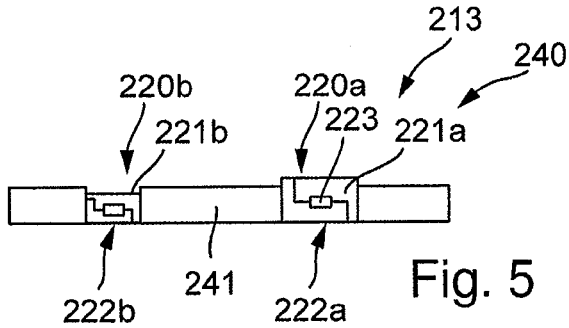
FIG. 5 shows a section through the plate of FIG. 4.

The sideways sectional representation in FIG. 5 shows that the touch pads 220 have been let in or incorporated or inserted into the plate 240 or the plate body 241. A touch pad 220*b* shown on the left may here be of recessed configuration, for example. The touch pad 220*a* shown on the right is somewhat higher than the plate body 241. This is intended to illustrate that there is plenty of leeway here for either highlighting or differentiating specific touch pad functions. The tops 221*a*-221*b* are in each case easy for a finger to reach and touch. The bottoms 222*a*, 222*b* should as far as possible be able to rest on a support, whether the work surface or a hob plate, for capacitive coupling or signal current transmission. The bottoms 222*a*-222*b* may thus be flush with the bottom of the plate body 241 or project somewhat therebeyond.

Such a plate 240 according to FIGS. 4 and 5 may easily to placed on an electrode surface 15 for operation and then removed again after operation. The structural effort required for this is relatively slight, depending on the manner in the touch pads are embedded. Instead of inserting separate touch pads similar to FIG. 3 into a plate body 241, they may also be produced by fitting conductive areas or parts.

Figure 6:
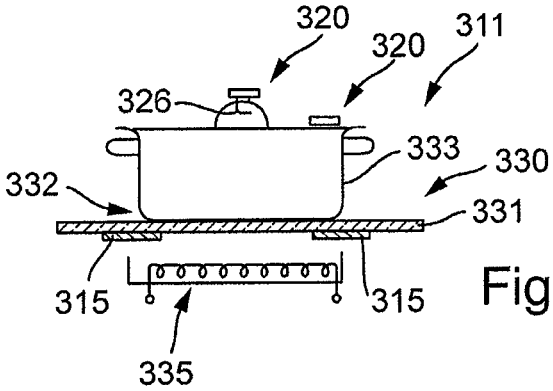
FIG. 6 shows a further configuration of an operating device according to one embodiment of the invention with touch pads, which are attached directly to the cooking utensil

FIG. 6 shows a further alternative embodiment of the invention. A pan 333 has been placed on a hob plate 331 of a hob 330. The corresponding hot plate 332 is heated by a heater 335 arranged under the hob plate 331. Although an electrode surface 315 is here attached to the bottom of the hob plate 331 as in FIG. 2, it is arranged on the one hand in the region of the heater 335 and must therefore be heat-resistant, depending on the type of heating system. It is moreover of annular construction and of a size which corresponds to the size of the hot plate 332 or the heater 335. The wide ring of the electrode surface 315 is dimensioned such that a pan 333 corresponding to this hot plate 332 lies with its edge above the electrode surface 315. It is then possible in one embodiment to attach touch pads 320*a* and 320*b* to the pan 333. This may proceed either by means of a clip 326 as described above on the lid handle or a pan handle. Alternatively, a touch pad 320*b* may be placed for example on the top of the lid by means of magnetic action or suction cups or the like.

Here too, as described above, when a finger is applied a signal pathway passes via or through the touch pad 320, then via the metallic pan 333 to the bottom thereof. From there, capacitive coupling proceeds via or through the hob plate 331 to the electrode surface 315, which is in turn connected to a controller, not shown. By way of the respective assignment of the electrode surface 315, selection of the corresponding hot plate 332 may immediately take place. The touch pads 320 again comprise individual coding for the purpose of differentiation, for example for power setting.

The touch pads 320 need not necessarily be connected electrically conductively to the metallic pan 333. A small air gap may be sufficient for a signal to be transmitted here too via capacitive coupling.

Figure 7:
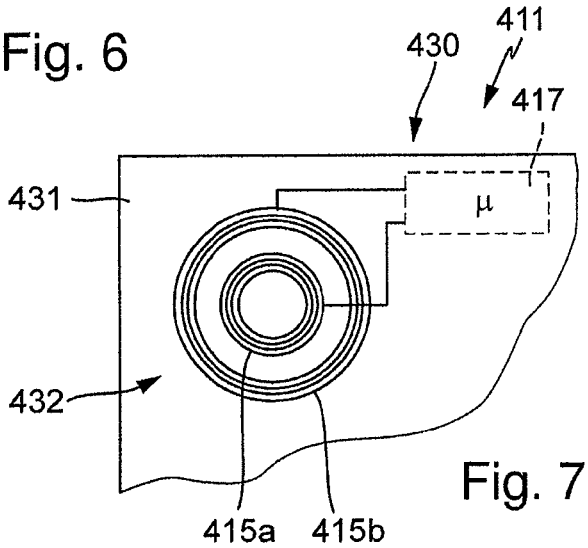
FIG. 7 shows one option for arranging two electrodes as an electrode surface corresponding to dual-circuit heating on a hob.

A further embodiment of the invention according to FIG. 6, is shown in FIG. 7 depicting a plan view of an arrangement 411. The hob 430 with the hob plate 431 comprises a dual-circuit hot plate 432*a*, i.e., with a small and a large ring. A smaller, annular electrode surface 415*a* corresponds to the dimensions of the smaller heating circuit and is configured in accordance with FIG. 6. A larger electrode surface 415*b* corresponds to the outer heating circuit. The two electrode surfaces 415*a* and 415*b* are connected to the controller 417 for evaluation. With the arrangement according to FIG. 7, it is possible to detect, by differentiating between electrode surfaces 415*a* and 415*b*, whether a small pan or a large pan has been placed thereon. The inputting or operating step which has otherwise conventionally to be taken may then be omitted. Otherwise, signal transmission proceeds in accordance with FIG. 6 with touch pads attached to a metallic pan.

It is above clear from FIG. 7 that, instead of the electrodes 415*a* and 415*b*, similarly shaped and extending coils of annular form could also be provided. In FIG. 1, for example, a coil could likewise enclose in annular manner the same area as the electrode surface 15.

The invention claimed is:

1. An operating device for an electric appliance comprising:

an electric hob, an oven, or a vent hood, said operating device having defined touch points and configured to be operated by application of a finger to one of said defined touch points, wherein said operating device comprises:

a plurality of touch pads with sensors as said touch points, said touch pads being structurally freely movable from said electric appliance and said operating device, said touch pads comprising individual coding circuits;

an electrode surface or a coil positioned on or next to said electric appliance said touch pads on said electrode surface or said coil, wherein a capacitive or an electromagnetic coupling is formed between said touch pads and said electrode surface or said coil; and a drive and evaluation circuit connected to said electrode surface or said coil configured to detect touching of one of said touch pads.

2. The operating device as claimed in claim 1, wherein said individual coding circuits are configured to modulate an electromagnetic field.

3. The operating device as claimed in claim 1, wherein said electric appliance comprises said electric hob, and wherein said electrode surface or said coil is arranged under a hob plate of said electric hob.

4. The operating device as claimed in claim 1, wherein said electric appliance comprises said electric hob, and wherein said electrode surface or said coil comprises a plurality of electrodes wherein a subset of said plurality of electrodes corresponds to a hot plate of said hob plate.

5. The operating device as claimed in claim 1, wherein said electric appliance comprises said electric hob, and wherein said electrode surface or said coil is fixed to a work surface next to a hob plate of said electric hob.

6. The operating device as claimed in claim 1, wherein said electric appliance comprises said vent hood, and wherein said electrode surface or said coil is provided on a front face of said vent hood.

7. The operating device as claimed in claim 1, wherein a plurality of said touch pads are connected together jointly and interconnectedly and at the same time configured to indicate different operating functions, and wherein said plurality of said touch pads have a flat, circular configuration.

8. The operating device as claimed in claim 1, wherein an energy storage means for providing power to said individual coding circuit is provided, wherein said storage means is located in said touch pad.

9. The operating device as claimed in claim 1, wherein each said touch pad has a flat, disk-like configuration with a metallic or electrically conductive outer zone.

10. The operating device as claimed in claim 1, wherein said metallic or electrically conductive outer zone is provided on a top of each said touch pad.

11. The operating device as claimed in claim 1, wherein said touch pad comprise attaching means for attaching said touch pad in fixed relationship to said electrode surface or said coil, wherein said attaching means are of detachable construction.

12. The operating device as claimed in claim 11, wherein said attaching means are configured to provide retention by means of magnetic force, each said touch pad comprising a retaining magnet for providing said magnetic force.

13. The operating device as claimed in claim 11, wherein said attaching means has a clamping action and is configured as a clip or a clamp.

14. The operating device as claimed in claim 1 wherein said operating device is further configured to detect and differentiate between touching of said touch pad and touching of another one of said touch pads using said individual coding circuit.

15. An electric hob comprising:

an operating device, said operating device having defined touch points and configured to be operated by application of a finger to one of said defined touch points, wherein said operating device comprises:

a plurality of touch pads with sensors as said touch points, said touch pads being structurally freely movable from said electric hob and said operating device, said touch pads comprising individual coding circuits;

an electrode surface or a coil positioned on or next to said electric hob said touch pads on said electrode surface or said coil, wherein a capacitive or an electromagnetic coupling is formed between said touch pads and said electrode surface or said coil;

a drive and evaluation circuit connected to said electrode surface or said coil configured to detect touching of one of said touch pads, and wherein said electrode surface or said coil is arranged on said electric hob.

16. The electric hob as claimed in claim 15, wherein said electrode surface or said coil is arranged under a hob plate of said electric hob, said electrode surface or said coil at least covering part of an area of said hob plate.

17. The electric hob as claimed in claim 15, wherein said operating device is in a work surface, wherein said electrode surface or said coil is positioned on said work surface.

18. The electric hob as claimed claim 17, wherein said electrode surface or said coil are positioned under said work surface and adjacent to said electric hob.

19. The operation device as claimed in claim 1 wherein:

the individual coding circuits generate respective individual codings, each of the individual codings correspond to one of the touch pads; and the drive and evaluation circuit is configured to detect the touching of said touch pad based in part on analyzing the individual coding associated with the touch pad.

20. The operating device of claim 19, wherein the drive and evaluation circuit is configured to analyze the individual coding to trigger an operation function assigned to the touch pad.

21. The electric hob as claimed in claim 15 wherein:

the individual coding circuits generate respective individual codings, each of the individual codings correspond to one of the touch pads; and the drive and evaluation circuit is configured to detect the touching of said touch pad based in part on analyzing the individual coding associated with the touch pad.

22. The electric hob of claim 21, wherein the drive and evaluation circuit is configured to analyze the individual coding to trigger an operation function assigned to the touch pad.

23. The operating device as claimed in claim 1, wherein the touch pads on said electrode surface or said coil are configured to operate in a plurality of positions.

24. The electric hob as claimed in claim 15, wherein the touch pads on said electrode surface or said coil are configured to operate in a plurality of positions.

* * * * *